US006778960B2

(12) United States Patent
Fukada

(10) Patent No.: US 6,778,960 B2
(45) Date of Patent: Aug. 17, 2004

(54) SPEECH INFORMATION PROCESSING METHOD AND APPARATUS AND STORAGE MEDIUM

(75) Inventor: Toshiaki Fukada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 487 days.

(21) Appl. No.: 09/818,626

(22) Filed: Mar. 28, 2001

(65) Prior Publication Data

US 2001/0032080 A1 Oct. 18, 2001

(30) Foreign Application Priority Data

Mar. 31, 2000 (JP) ..... 2000-099535

(51) Int. Cl.[7] ..... G10L 13/08; G10L 13/06
(52) U.S. Cl. ..... 704/260; 704/267; 704/278
(58) Field of Search ..... 704/260, 267, 704/278

(56) References Cited

U.S. PATENT DOCUMENTS 5,633,984 A 5/1997 Aso et al. ..... 395/2.69
5,745,650 A 4/1998 Otsuka et al. ..... 395/2.69
5,745,651 A 4/1998 Otsuka et al. ..... 395/2.77
5,845,047 A 12/1998 Fukada et al. ..... 395/2.77
6,546,367 B2 * 4/2003 Otsuka ..... 704/260

FOREIGN PATENT DOCUMENTS

EP 0 942 410 A2 9/1999
JP 11-259095 9/1999

* cited by examiner

*Primary Examiner*—Susan McFadden
(74) *Attorney, Agent, or Firm*—Fitzpatrick, Cella, Harper & Scinto

(57) ABSTRACT

A speech information processing apparatus which sets the duration of phonological series with accuracy, and sets a natural phoneme duration in accordance with phonemic/linguistic environment. For this purpose, the duration of predetermined unit of phonological series is obtained based on a duration model for entire segment. Then duration of each of phonemes constructing the phonological series is obtained based on the duration model for the entire segment. Then duration of each phoneme is set based on the duration of the phonological series and the duration of each phoneme.

11 Claims, 5 Drawing Sheets

SPEECH INFORMATION PROCESSING METHOD AND APPARATUS AND STORAGE MEDIUM

FIELD OF THE INVENTION

The present invention relates to a speech information processing method and apparatus for setting the duration of a phoneme upon speech synthesis, and a computer-readable storage medium holding a program for execution of a speech information processing method.

BACKGROUND OF THE INVENTION

Recently, a speech synthesis apparatus has been developed so as to convert an arbitrary character string into a phonological series and convert the phonological series into synthesized speech in accordance with a predetermined speech synthesis by rule.

However, the synthesized speech outputted from the conventional speech synthesis apparatus sounds unnatural and mechanical in comparison with natural speech sounded by human being.

For example, in a phonological series "o, X, s, e, i" of a character series "onsei", the accuracy of a rule for controlling the duration of generating each phoneme is considered as one of the factors of the awkward-sounding result. If the accuracy is low, as appropriate duration cannot be assigned to each phoneme, the synthesized speech becomes unnatural and mechanical.

SUMMARY OF THE INVENTION

The present invention has been made in consideration of the above prior art, and has as its object to provide a speech information processing method and apparatus for setting the duration of phonological series with high accuracy and setting natural phonological duration in accordance with phonemic/linguistic environment.

To attain the foregoing objects, the present invention provides a speech information processing apparatus comprising: means for obtaining a duration of a predetermined unit of phonological series based on a duration model for an entire segment; means for obtaining a duration of each of phonemes constructing the phonological series based on a duration model for a partial segment; setting means for setting a duration of each of the phonemes based on the duration of the phonological series and the duration of each of the phonemes; and speech synthesis means for synthesizing speech based on the duration of each of the phonemes set by the setting means.

Further, the present invention provides a speech information processing method comprising: a step of obtaining a duration of a predetermined unit of phonological series based on a duration model for an entire segment; a step of obtaining a duration of each of phonemes constructing the phonological series based on a duration model for a partial segment; a setting step of setting a duration of each of the phonemes based on the duration of the phonological series and the duration of each of the phonemes; and a speech synthesis step of synthesizing speech based on the duration of each of the phonemes set at the setting step.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Hereinbelow, preferred embodiments of the present invention will now be described in detail in accordance with the accompanying drawings.

FIRST EMBODIMENT

Figure 1:
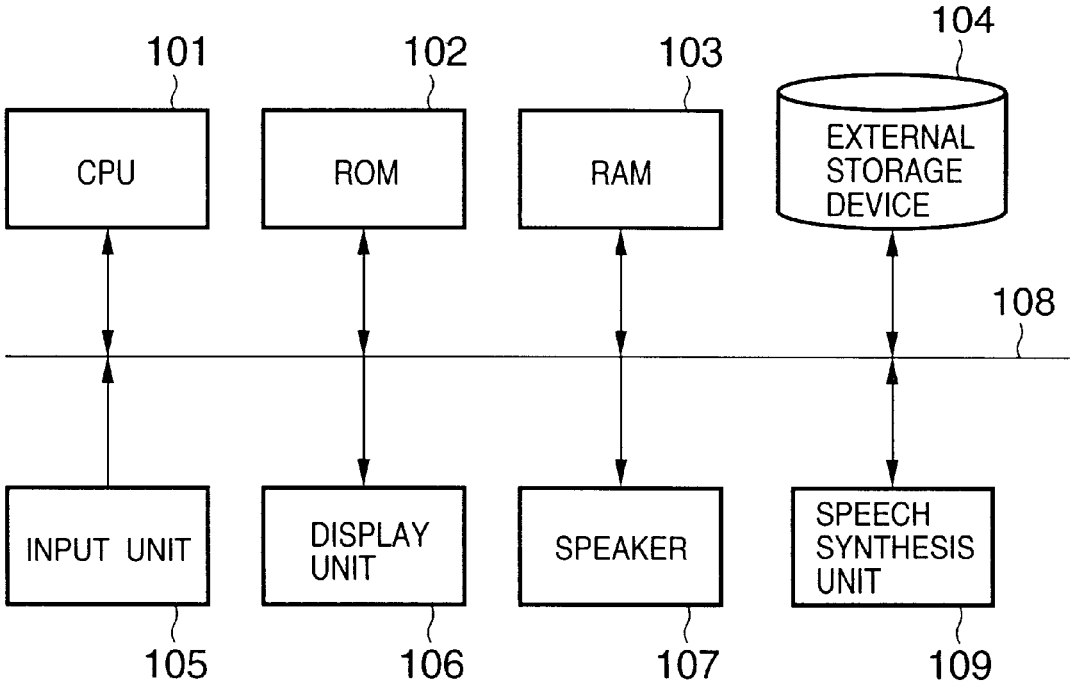
FIG. 1 is a block diagram showing the hardware construction of a speech synthesizing apparatus according to an embodiment of the present invention.

FIG. 1 is a block diagram showing the construction of a speech synthesizing apparatus according to a first embodiment of the present invention.

In FIG. 1, reference numeral 101 denotes a CPU which performs various controls in the speech synthesizing apparatus of the present embodiment in accordance with a control program stored in a ROM 102 or a control program loaded from an external storage device 104 onto a RAM 103. The control program executed by the CPU 101, various parameters and the like are stored in the ROM 102. The RAM 103 provides a work area for the CPU 101 upon execution of the various controls. Further, the control program executed by the CPU 101 is stored in the RAM 103. The external storage device 104 is a hard disk, a floppy disk, a CD-ROM or the like. If the storage device is a hard disk, various programs installed from CD-ROMS, floppy disks and the like are stored in the storage device. Numeral 105 denotes an input unit having a keyboard and a pointing device such as a mouse. Further, the input unit 105 may input data from the Internet via, e.g., a communication line. Numeral 106 denotes a display unit such as a liquid crystal display or a CRT, which displays various data under the control of the CPU 101. Numeral 107 denotes a speaker which converts a speech signal (electric signal) into speech as an audio sound and outputs the speech. Numeral 108 denotes a bus connecting the above units. Numeral 109 denotes a speech synthesis unit.

Figure 2:
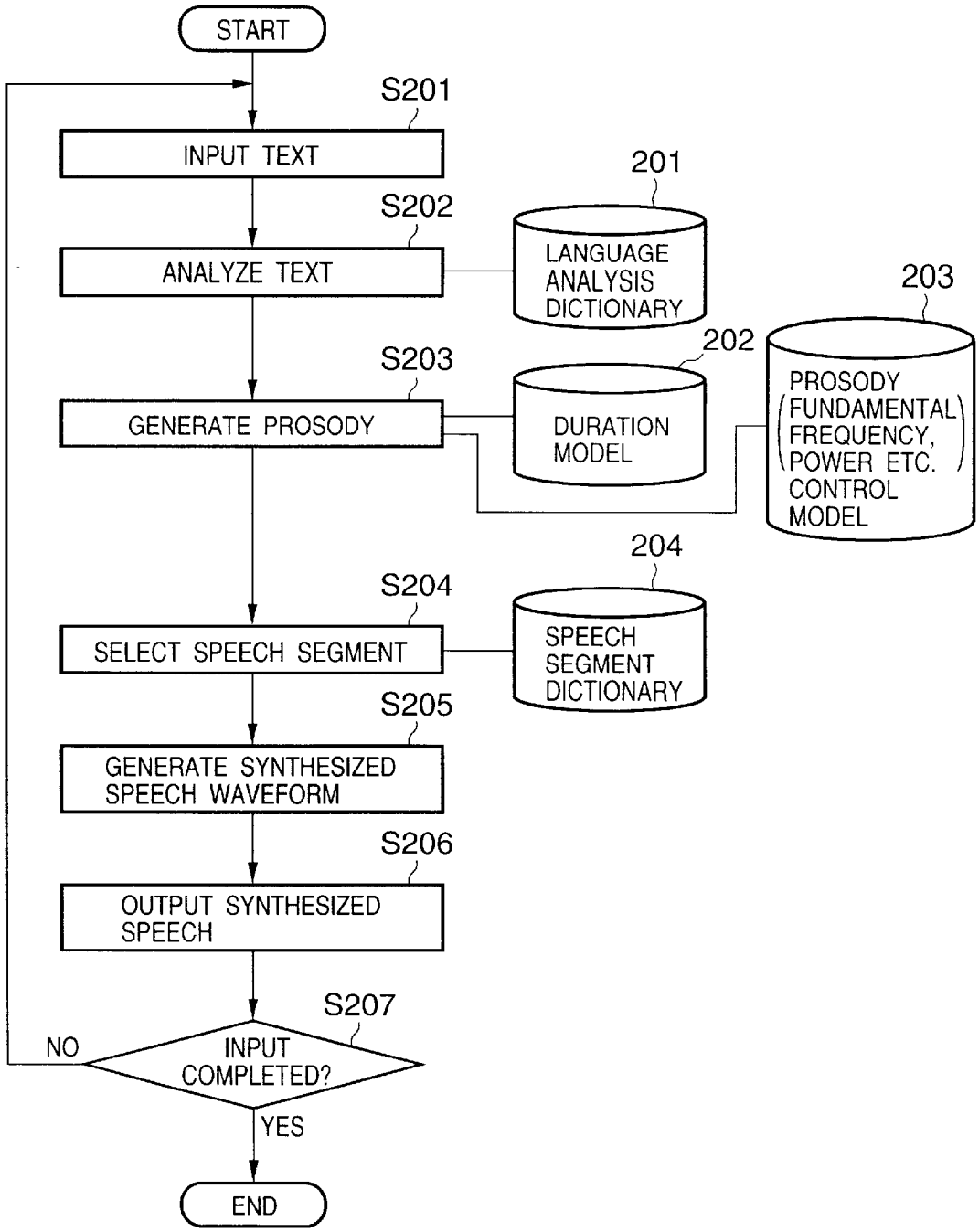
FIG. 2 is a flowchart showing a processing procedure of speech synthesis in the speech synthesizing apparatus according to the embodiment.

FIG. 2 is a flowchart showing the operation of the speech synthesis unit 109 according to the first embodiment. The following respective steps are performed by execution of the control program stored in the ROM 102 or the control program loaded from the external storage device 104 to the RAM 103, by the CPU 101.

At step S201, Japanese text data of Kanji and Kana letters, or text data in another language, is inputted from the input unit 105. At step S202, the input text data is analyzed by using a language analysis dictionary 201, and information on a phonological series (reading), accent and the like of the input text data is extracted. Next, at step S203, prosody (prosodic information) such as duration, fundamental frequency (pitch pattern), power and the like of each of phonemes forming the phonological series obtained at step S202 is generated by using the extracted information. At this time, the duration of the phoneme is determined by using a duration model 202, and the fundamental frequency, the power and the like are determined by using a prosody control model 203.

Next, at step S204, plural speech segments (waveforms or feature parameters) to form synthesized speech corresponding to the phonological series are selected from a speech segment dictionary 204, based on the phonological series extracted through analysis at step S202 and the prosody generated at step S203. Next, at step S205, a synthesized speech signal is generated by using the selected speech segments, and at step S206, speech is outputted from the speaker 107 based on the generated synthesized speech signal. Finally, at step S207, it is determined whether or not processing on the input text data has been completed. If the processing is not completed, the process returns to step S201 to continue the above processing.

Figure 3:
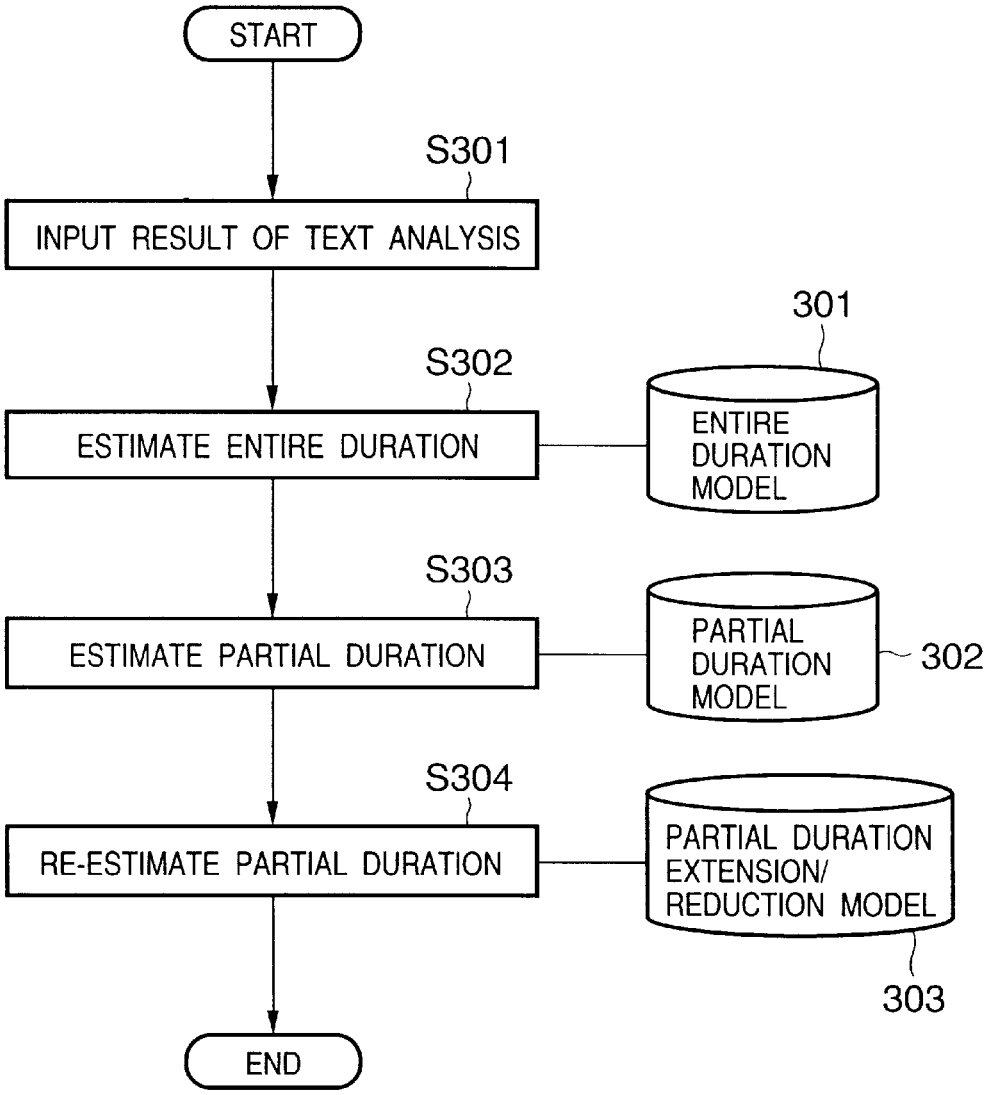
FIG. 3 is a flowchart showing a procedure of setting duration of phonological series using a duration model in prosody generation processing at step S203 in FIG. 2.

FIG. 3 is a flowchart showing in detail a part of the prosody generation processing at step S203 in FIG. 2. In FIG. 3, the duration model 202 is used for setting the duration of a predetermined unit of phonological series (hereinbelow referred to as an "entire segment") and the duration of each of the phonemes (hereinbelow referred to as a "partial segment") constructing the phonological series. Note that the duration model 202 includes a duration model 301 for entire segment (or entire duration model) and a duration model 302 for partial segment (or partial duration model).

First, at step S301, the result of analysis of the input text data obtained by the processing at step S202 is inputted. As the result of analysis, information on phonemic environment, obtained from phonemic information on phonemes, information on linguistic environment, obtained from linguistic information on the number of moras, the number of accent phrases, parts of speech and the like, are used. Next, the process proceeds to step S302, at which the duration of the entire segment is set based on the entire duration model 301. Note that the entire segment comprises a speech unit to be processed in one processing, such as an accent phrase, a word, a phrase and a sentence.

Next, the process proceeds to step S303, at which the duration of the partial segment is set based on the partial duration model 302. Note that the partial segment comprises a phonological unit constructing a speech unit such as a phoneme, a syllable and a mora.

Finally, the process proceeds to step S304, at which the duration of the partial segment is extended/reduced by using a partial duration extension/reduction model 303 such that the difference between the duration for the entire segment, obtained from the sum of the durations of the partial segments obtained at step S303, and the duration for the entire segment set at step S302, is the entire duration set at step S302. Thus the partial durations of the respective phonemes are determined.

As a particular example, in a case where text data "Hana ga" is inputted, a phonological series obtained by analysis of the character string is handled as an entire segment, and the entire segment is divided based on mora as a phonological unit, into partial segments "ha", "na" and "ga". Assuming that the average duration of the respective moras is 100 msec and the actually-measured duration of the entire segment is 600 msec, as the entire duration obtained by the sum of the partial durations is 300 msec, the difference between this entire duration and the actually-measured duration of the entire segment is 300 msec.

Next, a method for generating the entire duration model 301 for entire segment and processing for setting the duration for the entire segment at step S302 will be described with reference to the flowchart of FIG. 4.

Figure 4:
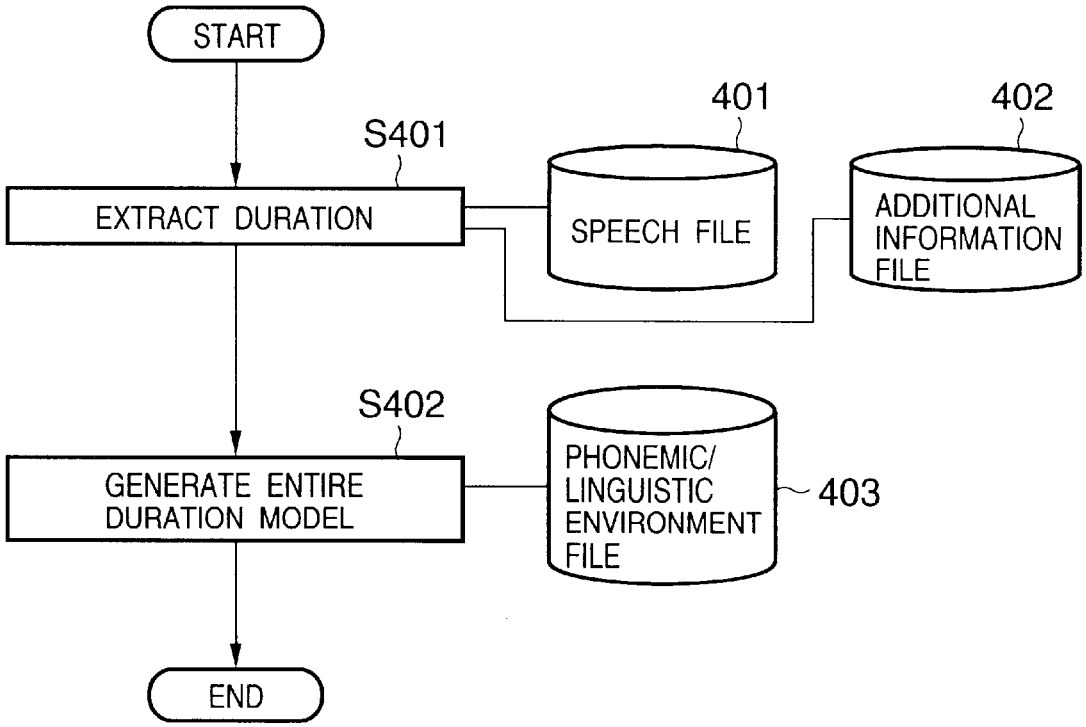
FIG. 4 is a flowchart showing a method for generating an entire duration model for an entire segment according to the embodiment.

FIG. 4 is a flowchart showing the method for generating the entire duration model for entire segment.

First, at step S401, an entire duration is extracted by using a speech file 401 having plural learned samples for generating an entire duration model for entire segment and a side information file having information necessary for extracting duration such as start and end time of a phoneme or syllable. Next, the process proceeds to step S402, at which the entire duration model 301 in consideration of predetermined linguistic environment is generated by using a phonemic/linguistic environment file 403 having information on phonemic environment obtained from phonemic information of a phoneme or the like and information on linguistic environment obtained from the number of moras, the number of accent phrases, parts of speech and the like, and the information on the entire duration extracted at step S401.

A particular processing procedure is as follows. The number of learned samples in the speech file 401 to generate the entire segment duration model 301 is K, and the duration of an entire segment in the k-th learned sample is dk. In the present embodiment, a model to directly predict the entire duration dk is not made but a model to predict a normalized duration sk from the entire segment duration dk by using an average duration $\bar{d}$ of the entire segment obtained from K learned samples is made.

$$sk=dk/\bar{d} \tag{1}$$

Note that the average duration $\bar{d}$ of the entire segment can be obtained by various methods. For example, in a case where the duration dk is an average mora duration (average duration per 1 mora), the duration $\bar{d}$ is obtained by:

$$\bar{d} = (1/K)\sum_{k=1}^{K}(dk/Nk) \tag{2}$$

Note that Nk is the number of moras in the k-th learned sample.

At this time, a predicted value $\hat{s}k$ of sk normalized from the entire duration dk is obtained by using a multiple linear regression analysis method:

$$\hat{s}k = a0 + \sum_{i=1}^{I}\sum_{j=1}^{Ji} ai,\ j \times xk,\ i,\ j \tag{3}$$

Note that I is the number of phonemic/linguistic environment items; and Ji, the number of categories for the item i (e.g., type of phoneme or the number of accent phrases). Further, xk,i,j are explanatory variables in a category j (e.g., phoneme set or accent type) of the item i in the sample k; ai,j, regression coefficients for the category j of the item i; and a0, a constant term. The entire duration dk of the entire segment for the k-th sample is obtained by using the predicted value ŝk from the expression (1):

$$\hat{d}k=\hat{s}k\times\bar{d} \quad (4)$$

This expression (4) is the entire duration model 301.

The values of the above I and Ji may be selected in various ways. For example, in a case where type of Japanese phoneme and the number of accent phrases in the entire segment are selected as the item i, and 26 types of phoneme sets and the number of accent phrases (1, 2, 3, 4 and more) in the entire segment are selected as the respective categories j, I=2, J1=26 and J2=4 hold.

Next, a method for generating the partial duration model 302 for partial segment and the processing for setting the partial duration for the partial segment at step S303 will be described with reference to the flowchart of FIG. 5. These processings are performed in a manner similar to that of the entire segment, as follows.

Figure 5:
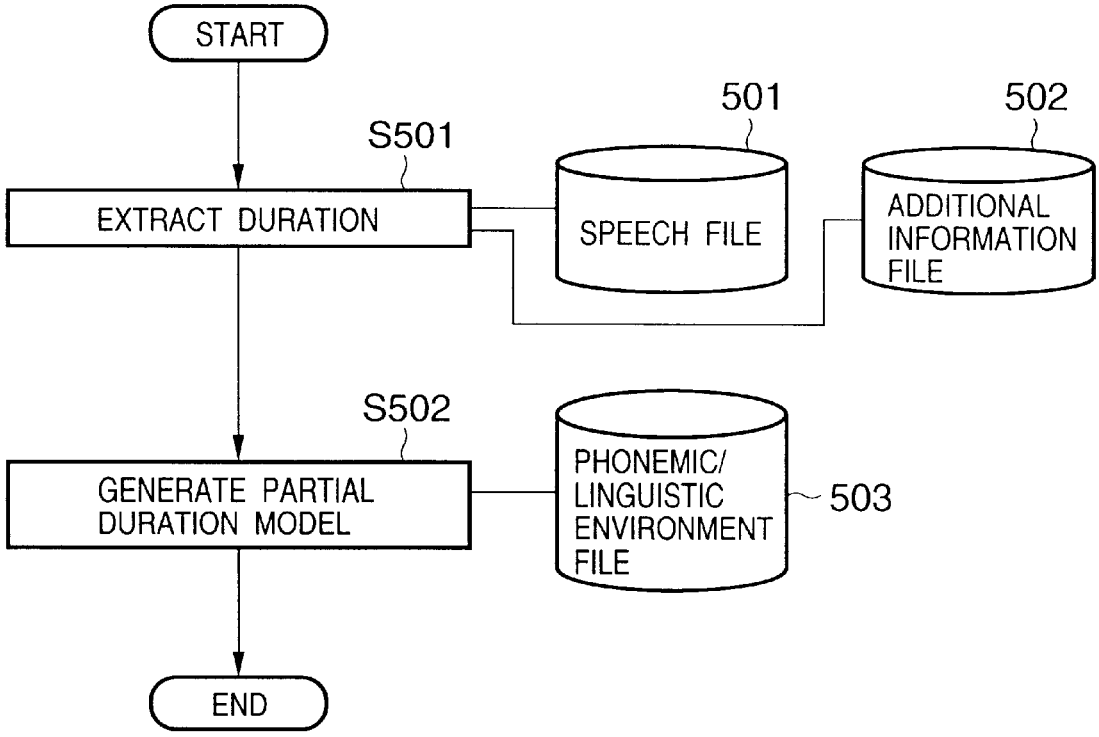
FIG. 5 is a flowchart showing a method for generating a partial duration model for a partial segment according to the embodiment.

FIG. 5 is a flowchart showing the method for generating a partial duration model for partial segment.

First, at step S501, a partial duration is extracted by using a speech file 501 having plural learned samples to generate a duration model for partial segment and a side information file 502 having information necessary for extracting duration such as start and end time of a phoneme or syllable. The process proceeds to step S502, at which the partial segment duration model 302 in consideration of predetermined phonemic environment is generated by using a phonemic/linguistic environment file 503 having information on phonemic environment obtained from phonemic information on a phoneme or the like and information on linguistic environment obtained from linguistic information such as the number of moras, the number of accent phrases and speech parts, and the partial duration information extracted at step S501.

As a particular process procedure, a method similar to that for generating the entire segment duration model 301 may be used. That is, it may be arranged such that a model is generated by normalizing partial duration by using an average duration of partial segments obtained from K learned samples, and the partial duration model 302 is generated based on the model.

Finally, the difference between the entire duration of entire segment obtained at step S302 and the entire duration of entire segment obtained from the sum of the partial durations for plural segments obtained at step S303 ((600-300=) 300 msec in the above example) is extended/reduced at step S304 such that the difference becomes equal to the entire duration of entire segment by using a statistical amount (average value, variance) related to duration of phoneme. As a particular method, Japanese Published Unexamined Patent Application No. Hei 11-259095 discloses an extension/reduction method using a statistical amount related to the duration of phoneme.

For example, in an example of determination of duration of a phoneme, an average value, a standard deviation, and a minimum value of the phoneme are obtained by type of phoneme (αi), and the obtained values are stored into a memory. These values are used for determining an initial value dαi of phoneme duration di related to the phoneme αi. Then, the phoneme duration di is determined based on the initial value.

$$di=d\alpha i+\rho(\sigma\alpha i)^2$$

$$\rho=(T-\Sigma d\alpha i)/\Sigma(\sigma\alpha i)^2$$

Note that T is duration of utterance $$\left(T=\sum_{i=1}^{N} di\right),$$

and σαi, the standard deviation of phoneme duration. Further, N is the total sum of the number of samples.

SECOND EMBODIMENT

In the first embodiment, a model to estimate the expression (1) where the entire segment duration dk is divided by entire segment average duration $\bar{d}$ is learned, and partial duration is re-estimated by using entire duration obtained from this model. Next, as a second embodiment, an entire duration model is formed based on the difference between the entire segment duration and the average duration. Note that the hardware construction and the procedures of the second embodiment are similar to those of the first embodiment (FIGS. 1 to 5) and therefore the explanations of the construction and the procedures will be omitted.

In the second embodiment, the expression (1) in the first embodiment is changed to:

$$Sk=dk-\bar{d} \quad (5)$$

and the average duration $\bar{d}$ is subtracted from the entire segment duration by learned sample, thus the value sk normalized from the duration dk is obtained. The obtained sk is used for generating the sk prediction model as in the expression (3) by using the linear multiple regression analysis method as in the case of the first embodiment. The entire segment duration $^{d}$ k for the k-th sample is obtained as follows from the expression (5):

$$\bar{d}=\bar{s}\bar{d} \quad (6)$$

This expression (6) is the entire duration model in the second embodiment. The partial duration model can be obtained by modeling using a similar method.

Note that the constructions in the above embodiments merely show embodiments of the present invention and various modification as follows can be made.

In the above embodiments, the average mora duration is used as the entire segment duration $\bar{d}$; however, the acquisition of average duration by mora is an example, and the average duration may be obtained in other phonological units such as syllable and phoneme. Further, the present invention is applicable to languages other than Japanese.

In the above embodiments, the item and the category of the entire segment multiple linear regression model are used in an example, and other items and categories may be used.

Further, the object of the present invention can also be achieved by providing a storage medium storing software program code for performing functions of the aforesaid processes according to the above embodiments to a system or an apparatus, reading the program code with a computer (e.g., CPU, MPU) of the system or apparatus from the storage medium, and then executing the program. In this case, the program code read from the storage medium realizes the functions according to the embodiments, and the storage medium storing the program code constitutes the invention. Further, the storage medium, such as a floppy disk, a hard disk, an optical disk, a magneto-optical disk, a CD-ROM, a CD-R, a DVD, a magnetic tape, a non-volatile type memory card, and a ROM can be used for providing the program code.

Furthermore, besides aforesaid functions according to the above embodiments being realized by executing the program code which is read by a computer, the present invention includes a case where an OS (operating system) or the like working on the computer performs a part of or entire processes in accordance with designations of the program code and realizes functions according to the above embodiments.

Furthermore, the present invention also includes a case where, after the program code read from the storage medium is written in a function expansion card which is inserted into the computer or in a memory provided in a function expansion unit which is connected to the computer, a CPU or the like contained in the function expansion card or unit performs a part of or an entire process in accordance with designations of the program code and realizes functions of the above embodiments.

As described above, according to the present invention, the duration can be modeled with higher accuracy by using means for setting entire and partial segment durations more accurately. Thus the naturalness of intonation generation in the speech synthesis apparatus can be improved.

As described above, according to the present invention, the duration of phonological series can be set with high accuracy, and natural duration can be set in accordance with phonemic/linguistic environment.

The present invention is not limited to the above embodiments, and various changes and modifications can be made within the spirit and scope of the present invention. Therefore, to apprise the public of the scope of the present invention, the following claims are made.

What is claimed is:

1. A speech information processing method comprising:

a step of obtaining a duration of a predetermined unit of phonological series based on a duration model for an entire segment;

a step of obtaining a duration of each of phonemes constructing said phonological series based on a duration model for a partial segment;

a setting step of setting a duration of each of said phonemes based on said duration of the phonological series and said duration of each of said phonemes; and a speech synthesis step of synthesizing speech based on said duration of each of said phonemes set at said setting step.

2. The speech information processing method according to claim 1, wherein said partial segment comprises at least any one of a phoneme, a syllable and a mora, and wherein said entire segment comprises at least any one of an accent phrase, a word and a phrase.

3. The speech information processing method according to claim 1, wherein said duration model for said entire segment is obtained by modeling based on a ratio between said duration of said entire segment and an average duration of said entire segment.

4. The speech information processing method according to claim 1, wherein said duration model for said entire segment is obtained by modeling based on a difference between said duration of said entire segment and an average duration of said entire segment.

5. The speech information processing method according to claim 1, wherein said duration model for said entire segment is a model obtained by modeling by a multiple linear regression model.

6. A computer-readable storage medium holding a program for executing the speech information processing method in claim 1.

7. A speech information processing apparatus comprising:

means for obtaining a duration of a predetermined unit of phonological series based on a duration model for an entire segment;

means for obtaining a duration of each of phonemes constructing said phonological series based on a duration model for a partial segment;

setting means for setting a duration of each of said phonemes based on said duration of the phonological series and said duration of each of said phonemes; and speech synthesis means for synthesizing speech based on said duration of each of said phonemes set by said setting means.

8. The speech information processing apparatus according to claim 7, wherein said partial segment comprises at least any one of a phoneme, a syllable and a mora, and wherein said entire segment comprises at least any one of an accent phrase, a word and a phrase.

9. The speech information processing apparatus according to claim 7, wherein said duration model for said entire segment is obtained by modeling based on a ratio between said duration of said entire segment and an average duration of said entire segment.

10. The speech information processing apparatus according to claim 7, wherein said duration model for said entire segment is obtained by modeling based on a difference between said duration of said entire segment and an average duration of said entire segment.

11. The speech information processing apparatus according to claim 7, wherein said duration model for said entire segment is a model obtained by modeling by a multiple linear regression model.

* * * * *

UNITED STATES PATENT AND TRADEMARK OFFICE

CERTIFICATE OF CORRECTION

PATENT NO. : 6,778,960 B2
DATED : July 6, 2004
INVENTOR(S) : Toshiaki Fukada et al.

It is certified that error appears in the above-identified patent and that said Letters Patent is hereby corrected as shown below:

Title page,
Item [*] Notice, should read:
-- Subject to any disclaimer, the term of this patent is extended or adjusted under 35 U.S.C. 154(b) by 541 days. --.

Signed and Sealed this

First Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,778,960 B2
DATED : August 17, 2004
INVENTOR(S) : Toshiaki Fukada

It is certified that error appears in the above-identified patent and that said Letters Patent is hereby corrected as shown below:

Title page,
Item [57], ABSTRACT,
Line 4, "of" should read -- of a --.
Line 6, "for" should read -- for an --, and "Then" should read -- Then, --.
Line 8, "the" should read -- a --, and "the entire" should read -- a partial --.
Line 9, "Then" should read -- Then, --.

Column 6,
Lines 36-37, " $\bar{d}=\bar{s}\ \bar{d}$ " should read -- $\hat{d}=\hat{s}k+\bar{d}$ --.

Signed and Sealed this

Seventh Day of March, 2006

JON W. DUDAS
*Director of the United States Patent and Trademark Office*